US007378933B2

(12) United States Patent
Rogers

(10) Patent No.: US 7,378,933 B2
(45) Date of Patent: May 27, 2008

(54) DUAL FUSE HOLDER

(76) Inventor: Jonathan Paige Rogers, 5220 Gold Mine Rd., Frederick, MD (US) 21703

( * ) Notice: Subject to any disclaimer, the term of this patent is extended or adjusted under 35 U.S.C. 154(b) by 367 days.

(21) Appl. No.: 11/087,812

(22) Filed: Mar. 24, 2005

(65) Prior Publication Data

US 2006/0214762 A1 Sep. 28, 2006

(51) Int. Cl.
*H01H 85/20* (2006.01)

(52) U.S. Cl. ..... 337/227; 337/5; 361/104

(58) Field of Classification Search ..... 337/165, 337/261, 178, 227, 5; 361/104
See application file for complete search history.

(56) References Cited

U.S. PATENT DOCUMENTS

| | | | | |
|---|---|---|---|---|
| 884,519 | A | 4/1908 | McDonald | |
| 3,435,291 | A | 3/1969 | Paulus | |
| 3,444,497 | A | 5/1969 | Charbonneau | |
| 4,008,452 | A | 2/1977 | Cameron | |
| 4,010,437 | A | 3/1977 | Macemon et al. | |
| 4,041,435 | A * | 8/1977 | Gaia | 337/159 |
| 4,053,861 | A * | 10/1977 | Knapp, Jr. | 337/165 |
| 4,082,408 | A * | 4/1978 | Angelis | 439/698 |
| 4,257,662 | A * | 3/1981 | Motten, Jr. | 439/831 |
| 4,593,262 | A * | 6/1986 | Krueger | 337/163 |
| 4,616,207 | A * | 10/1986 | Knapp et al. | 338/32 H |
| 4,759,730 | A * | 7/1988 | Sappington et al. | 439/620.3 |
| 4,806,898 | A * | 2/1989 | Osborne | 337/146 |
| 5,128,648 | A * | 7/1992 | Brandi | 337/169 |
| 5,757,260 | A | 5/1998 | Smith et al. | |
| 5,760,673 | A | 6/1998 | Hassler et al. | |
| 5,796,326 | A * | 8/1998 | Benito | 337/169 |
| 5,982,267 | A | 11/1999 | Locht | |
| 6,304,429 | B1 * | 10/2001 | Locht et al. | 361/623 |

OTHER PUBLICATIONS

G&W Electric Company drawing C5112 0009 000, "High Current Limiter Rated 15.5kV, 25 Amps Continuous Current, 80 kA RMS SYM Interrupt Rating", May 6, 1999.

* cited by examiner

*Primary Examiner*—Anatoly Vortman
(74) *Attorney, Agent, or Firm*—Venable LLP; Michael A. Sartori; Steven J. Schwarz

(57) ABSTRACT

A fuse holder having at least two separate electrical paths may include a first hollow support containing a first fuse and a second hollow support containing a second fuse. The first hollow support may have first electrical connection devices, and the second hollow support may have second electrical connection devices. A support member may be coupled to the first hollow support and to the second hollow support. The support member, the first hollow support, and the second hollow support may be made of a non-conductive material.

8 Claims, 8 Drawing Sheets

DUAL FUSE HOLDER

FIELD OF THE INVENTION

The invention relates to a dual fuse holder. More specifically, the invention relates to a dual fuse holder that may be placed in an electrical utility distribution system for use with a power line data communication system.

BACKGROUND OF THE INVENTION

This invention relates to a dual fuse holder for providing electrical circuitry protection to the supply side and the load side of an electrical utility distribution system, which may include, for example, low-current electrical devices. One exemplary use of the dual fuse holder is for protecting electrical equipment in a power line data communication system.

Over the past few decades, much interest has been placed on delivering data over reliable electrical networks. More recently, the power grid has emerged as a viable alternative to telephone and cable networks due to improved modulation techniques increasing data rates across the power lines. Power line communication (PLC) relies on the existing power grid infrastructure, thus significantly reducing the costs in implementing a data network. However, one cost associated with a PLC system involves the equipment at or near the customer premises that allows the customer to receive a radio frequency (RF) data signal from the power lines.

One problem in delivering the data signal across the power grid lines is that transformers damage the RF data signal. While a transformer is necessary for stepping down voltage to a customer useable level, a transformer also prevents or significantly inhibits the ability of a receiving device to recover a transmitted RF data signal. When transporting electricity from the electrical substation to the customer, typically the voltage may be stepped down through one or more transformers to power lines that lead into the customer's home, business, or building. In implementing a PLC system, the transformer is typically bypassed through separate equipment to preserve the RF data signal.

Conventionally, PLC systems are implemented using existing electrical utility distribution system equipment to bypass a transformer. FIG. 7 is a photograph of a PLC system 700 using such existing electrical utility distribution system equipment. A power line 702 is connected to a utility pole 704, and a choke bushing 706 is arranged on the power line 702. Two fused cutouts 710A and 710B are coupled to the choke bushing 706 through wires 708A and 708B, respectively. The two fused cutouts 710A and 710B include fuse devices 712A and 712B, respectively, which hold fuse links. A bracket 714 supports the two fused cutouts 710A and 710B. A coupler 716 is attached to the bracket 714 and coupled to the two fused cutouts 710A and 710B. A coaxial cable 718 is coupled to the coupler 716 and also connects to low voltage lines that lead into a building.

The fused cutouts 710A and 710B create an open circuit by switching through mechanical separation. The fused cutouts 710A and 710B are shown in a mechanically separated position. The mechanically separated condition may occur when a fuse door of the fused cutout is opened with a switch stick, when a fuse link is broken by pulling or pushing on a breaking device included in a tensioning device, or when the fuse links in the fuse devices 712A and 712B, respectively, are overloaded after receiving an electrical current greater than a rated electrical current level for the fuse link. In the first instance above, the mechanical separation de-energizes and isolates an electrical circuit without damaging the fuse link. In the latter two instances, the mechanical separation of the fused cutout occurs after the fuse is damaged: either manually by the breaking device or after the fuse link is overloaded. An overload causes the fuse link to melt and the fused cutouts 710A and 710B to separate due to a loss of tension on the fuse link.

One problem with using existing electrical utility distribution system equipment is the significant costs associated with using this equipment in a PLC system. The electrical utility distribution system equipment is designed to protect electrical utility power equipment, and does not cost effectively meet the needs of the PLC system. The fuses in conventional electrical utility system equipment are rated to protect against damaging electrical current surges in electrical power distribution, and are grossly oversized for PLC equipment. In PLC systems, the RF data signal electrical current is much smaller in comparison to the electrical current associated with electrical power distribution. What is needed is a fuse holder designed for the requirements of the PLC industry, rather than the electrical utility industry.

SUMMARY OF THE INVENTION

The invention includes an apparatus and a system using the apparatus.

The apparatus of the invention may include a fuse holder having at least two separate electrical paths. The fuse holder may include a first hollow support containing a first fuse and a second hollow support containing a second fuse. The first hollow support may have first electrical connection devices, and the second hollow support may have second electrical connection devices. A support member may be coupled to the first hollow support and the second hollow support. The support member, the first hollow support, and the second hollow support may be made of a non-conductive material.

The system of the invention may electrically couple a primary power line to at least one secondary power line. The system may include a choke bushing electrically coupled to the primary power line, and a fuse holder may be electrically coupled to the primary power line at the choke bushing. A coupler may be electrically coupled to the fuse holder, and a power line bridge may be electrically coupled between the at least one secondary power line and the coupler.

Moreover, the above objects and advantages of the invention may be illustrative, and not exhaustive, of those which can be achieved by the invention. Thus, these and other objects and advantages of the invention will be apparent from the description herein, both as embodied herein and as modified in view of any variations which will be apparent to those skilled in the art.

BRIEF DESCRIPTION OF THE DRAWINGS

The foregoing and other features and advantages of the invention will be apparent from the following, more particular description of the embodiments of the invention, as illustrated in the accompanying drawings.

DETAILED DESCRIPTION OF THE EMBODIMENTS

Figure 1:
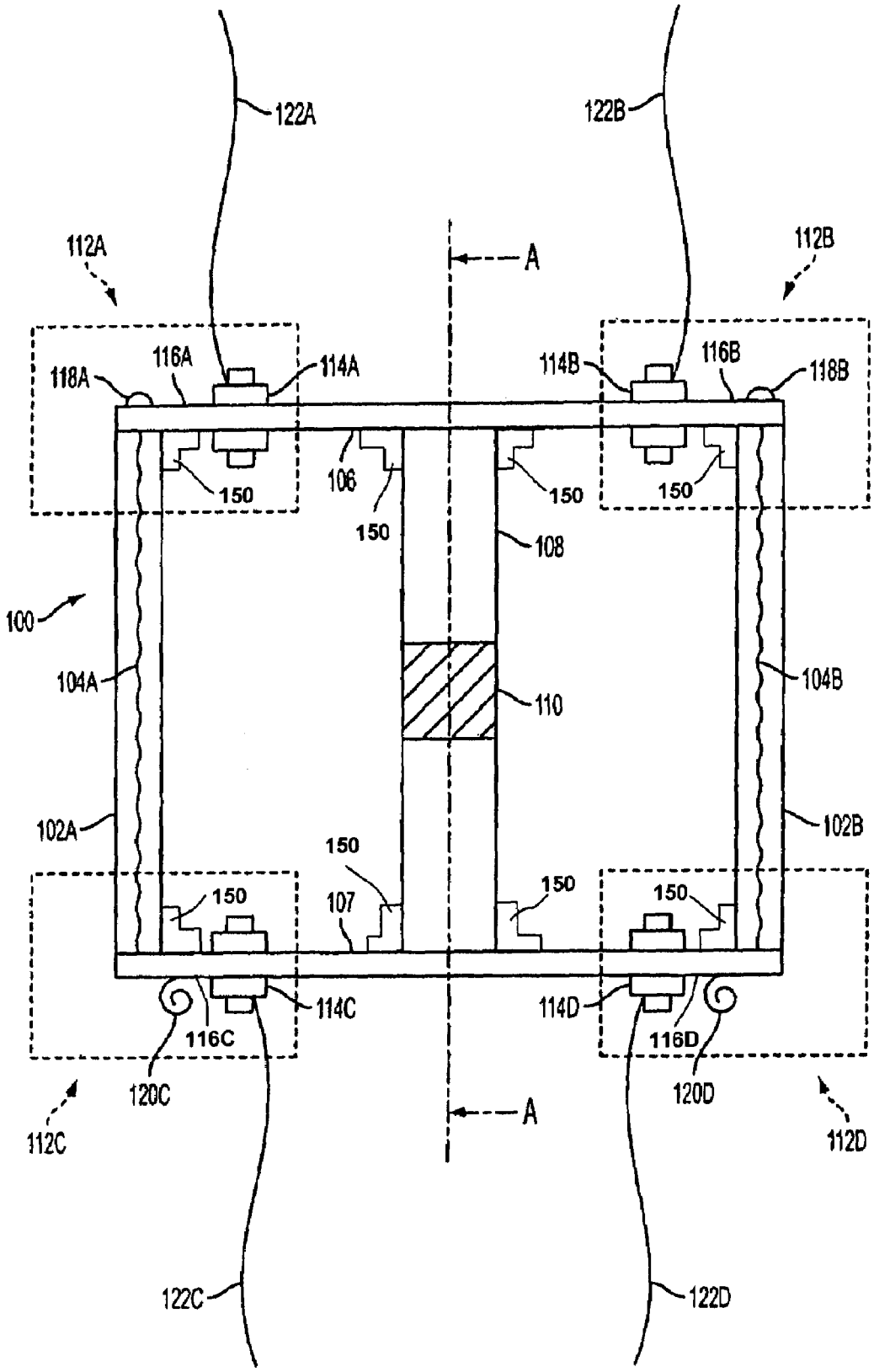
FIG. 1 illustrates a front view of a first exemplary embodiment of a dual fuse holder according to an embodiment of the invention.

In describing the exemplary embodiments of the present invention illustrated in the drawings, specific terminology is employed for the sake of clarity. However, the invention is not intended to be limited to the specific terminology so selected. It may be understood that each specific element includes all technical equivalents that operate in a similar manner to accomplish a similar purpose.

Figure 2:
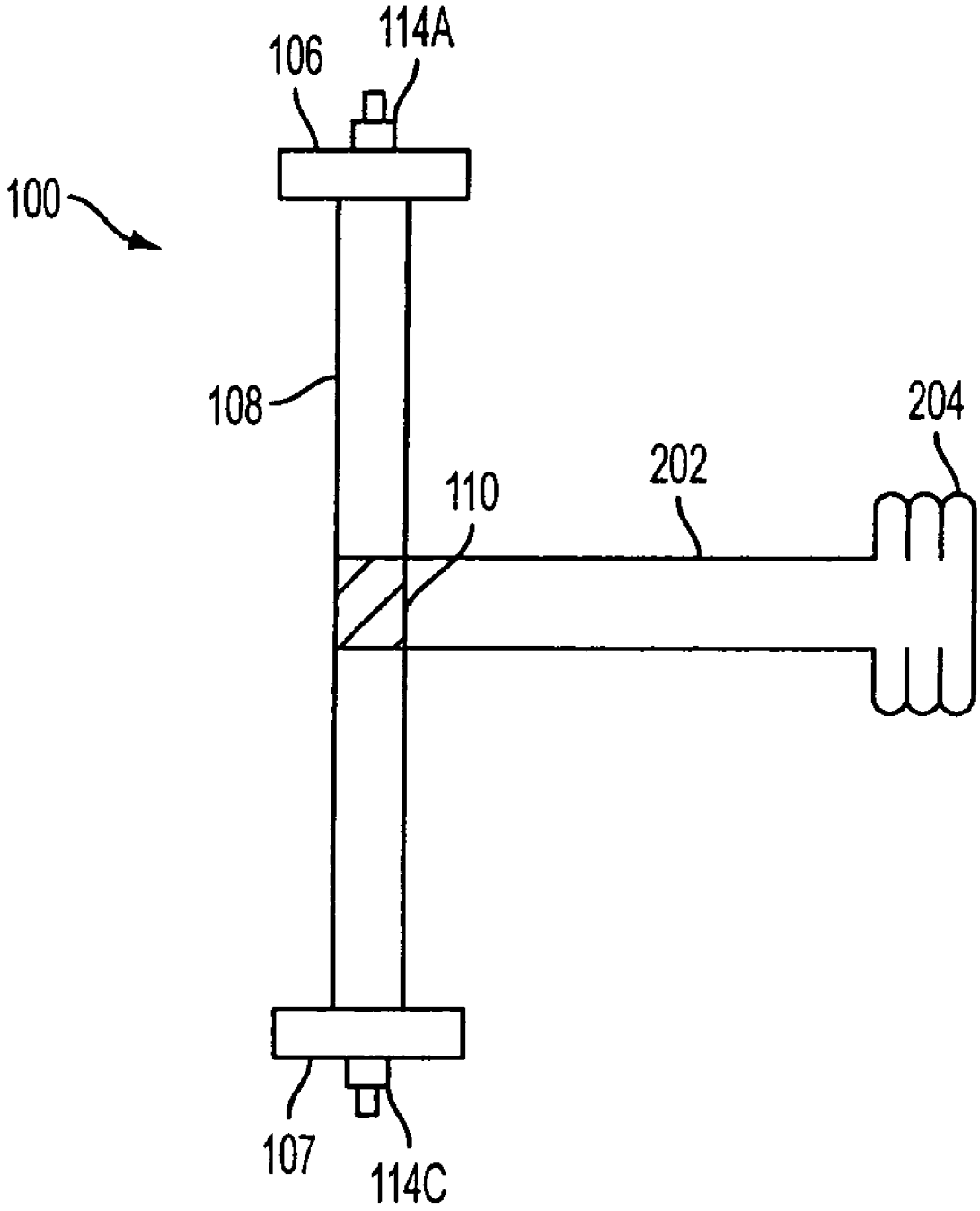
FIG. 2 illustrates a cross-sectional side view along line A-A of the dual fuse holder of FIG. 1.
Figure 3:
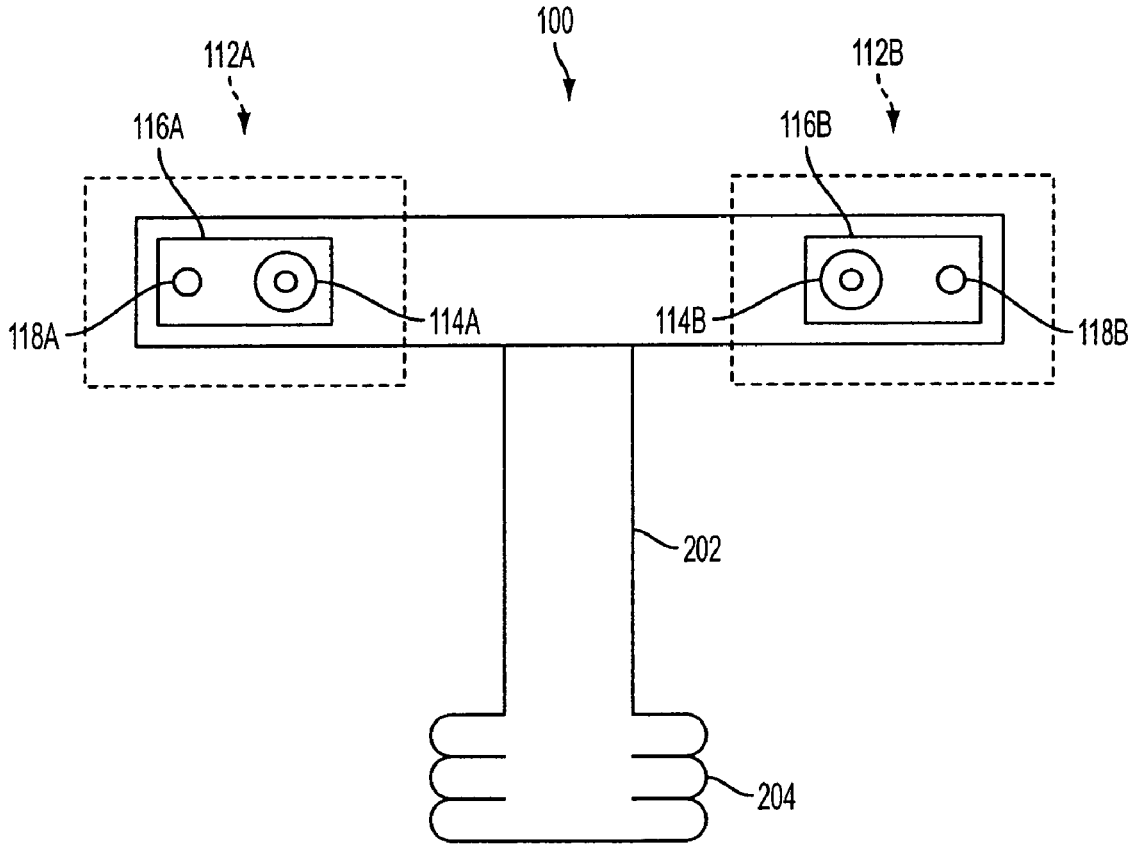
FIG. 3 illustrates a top view of the dual fuse holder of FIG. 1.

FIG. 1 illustrates a front view of a first exemplary embodiment of a dual fuse holder 100 according to an embodiment of the invention. FIG. 2 illustrates a cross-sectional side view along line A-A of the dual fuse holder 100 of FIG. 1. FIG. 3 illustrates a top view of the dual fuse holder 100 of FIG. 1. It is noted that the different views of the exemplary fuse holder in FIGS. 1-3 are symmetric; however, the fuse holder may be constructed asymmetrically without departing from the scope of the invention, as would be understood by one of ordinary skill in the art. The exemplary embodiment will be initially discussed with respect to FIGS. 1-3.

A first hollow support 102A may contain a fuse link 104A, and a second hollow support 102B may contain a fuse link 104B. The fuse links 104A and 104B may not be visible from the exterior of the hollow supports 102A and 102B, and are illustrated in the drawings to depict the invention. A top support 106 and a bottom support 107 may be attached to both the first hollow support 102A and the second hollow support 102B. The hollow supports 102A and 102B may have any arbitrary shape that may be hollow between the top support 106 and the bottom support 107. Examples of hollow supports 102A and 102B may be: hollow cylinders; supports having three or more substantially flat sides; or any other hollow support having a symmetrical or asymmetrical cross section. The hollow supports 102A and 102B may have different shapes.

A connection device 112A may electrically couple the fuse link 104A and an electrical line 122A. A connection device 112B may electrically couple the fuse link 104B and an electrical line 122B. A connection device 112C may electrically couple the fuse link 104A and an electrical line 122C. A connection device 112D may electrically couple the fuse link 104B and an electrical line 122D. The connection devices 112A and 112B may be coupled to the top support 106, and the connection devices 112C and 112D may be coupled to the bottom support 107. Alternatively, the connection devices 112A and 112B may be coupled to the first hollow support 102A, and the connection devices 112C and 112D may be coupled to the second hollow support 102B. The fuse holder 100 may not generally include the electrical lines 122A, 122B, 122C, and 122D.

The connection device 112A may provide electrical continuity at the end of the fuse link and may include connectors adapted to electrically connect the fuse link with an external wire connection. The connection device 112A may include a wire connector 114A and a conductive strip 116A. The conductive strip 116A may electrically couple the fuse link 104A and the wire connector 114A. The wire connector 114A may electrically couple the conductive strip 116A and the electrical line 122A. Alternatively, the wire connector 114A may electrically couple the fuse 104A and the electrical line 122A without using the conductive strip 116A. In a further alternative embodiment, a cast fitting including both the wire connector 114A and the conductive strip 116A may be used. Other connection devices 112A will become apparent to those skilled in the art. Components similar to those of the connection device 112A may be used for the connection devices 112B, 112C and 112D and will not be described further. The connection devices 112A, 112B, 112C, and 112D may or may not be the same.

In an exemplary embodiment, the connection devices 112A and 112C may connect to the respective ends of the fuse link 104A. The fuse link 104A may be connected to the wire connectors 114A and 114C of the connection devices 112A and 112C. Alternatively, the fuse link 104A may be connected to the conductive strips 116A and 116C of the connection devices 112A and 112C. The fuse link 104B may connect similarly between the connection devices 112B and 112D.

The connection devices 112C and 112D may include springs 120C and 120D to provide tension on the fuse links 104A and 104B. The springs 120C and 120D may be located external to the bottom support 107. In alternative embodiments, the springs 120C and 120D may be located internal to the hollow supports 102A and 102B, or may be located at other locations on the fuse holder 100. The springs 120C and 120D may use a rolled leaf spring to provide tension to the fuse. Other devices may be used to provide tension on the fuse links 104A and 104B, as will be apparent to those skilled in the art.

The fuse links 104A and 104B may electrically protect the electrical system from any surges or malfunctions of the PLC equipment, and also may protect the PLC equipment from any surges or malfunctions of the electrical utility distribution lines. In the present embodiment, any fuse link may be used that provides electrical and physical continuity between the top and bottom of the fuse holder 100 (and the external connections at each end of the fuse holder 100) and that opens the electrical circuit when a surge in electrical current is received on the line side or on the load side of the fuse links 104A or 104B. The open circuit in the fuse links 104A and 104B may prevent electricity from passing through the fuse holder 100 and may protect the equipment on either side of the fuse holder 100 from the surge. The surge may be caused by an electrical malfunction, such as an overload or a short circuit, and may occur on either electrical side (e.g. the line side or the load side) of the circuit of which the fuse links 104A and 104B are included.

Both of the fuse links 104A and 104B may be non-switchable fuse links, and instead of switching, the fuse links may do something else, such as, for example, melt. The fuse links 104A and 104B may include, for example, a solder element wrapped in a cardboard tube electrically coupled between two copper wires. In an alternative embodiment, the fuse links 104A and 104B may include conductive wires other than copper, as is known to those skilled in the art. Examples of the fuse links 104A and 104B may include type N fuse links or string fuses. Other types of fuse links may be used as will become apparent to those skilled in the art.

In one embodiment, the fuse links 104A and 104B may have a rated level for electrical current. When a surge in electrical current greater than the rated level passes across the fuse link, the solder element may melt, thus disconnecting the electrical connection between two copper wires of the fuse link and creating an open circuit. The electrical current rating level of the fuse link may be selected to meet the electrical current protection needs of the electrical equipment. The rated level of electrical current for the fuse links 104A and 104B may be, for example, generally between approximately 1 Ampere (A) and approximately 100 A, but could be as little as approximately 0.001 A and as large as approximately 100 A.

If the fuse links 104A and 104B are designed to melt, and if they do so, the springs 120C or 120D may pull the fuse links 104A or 104B apart to facilitate the disconnection of the electrical connection and to release the tension in the springs 120C and 120D. In an embodiment incorporating a cast fitting having a hinge, one of the springs 120C and 120D may pull the respective fuse link 104A or 104B apart as they melt to open the hinge and to create an open circuit due to a loss in electrical contact across the hinge. However, the invention does not necessarily require the springs 120C and 120D, because melting the fuse link 104A or 104B may be sufficient to create an open circuit.

Caps 118A and 118B may be placed at the top support 106 on the top ends of the respective hollow supports 102A and 102B. As illustrated, the caps 118A and 118B may be placed at the ends of the first hollow support 102A and the second hollow support 102B to protect the fuse links 104A and 104B contained in the hollow supports 102A and 102B from rain and other conditions, such as, for example, weather conditions. Caps may be omitted from the bottom ends of the hollow supports 102A and 102B to allow for ventilation and to prevent moisture accumulation within the hollow supports 102A and 102B. The cap 118A may be located on the top support 106 above the hollow support 102A. The cap 118B may be located on the top support 106 above the hollow support 102B. The caps 118A and 118B may be made of a conductive material. In an alternative embodiment, the caps 118A and 118B may be made of a non-conductive material.

An attachment support 108 may be coupled between the top support 106 and the bottom support 107. A mounting support 202 (FIGS. 2 and 3) may be coupled to the attachment support 108 at an attachment area 110. The attachment area 110 is shown as a hashed area for illustrative purposes to depict where the mounting support 202 couples to the attachment support 108. The mounting support 202 may include a mounting bracket 204 adapted to, for example, couple the fuse holder 100 to a convention electrical utility system bracket. The conventional electrical utility system bracket may be used to attach electrical utility hardware and equipment to utility poles or cross arms. In an alternative embodiment, the attachment area 110 may be positioned at other locations on the attachment support 108, on either of the hollow supports 102A or 102B, on either of the top support 106 or bottom support 107, or on any combination of one or more of the supports as will be appreciated by those skilled in the art.

The first hollow support 102A, the second hollow support 102B, the top support 106, the bottom support 107, the attachment support 108, and the mounting support 202 may be made of a non-conductive material. Examples of non-conductive materials for use with the present embodiment include: an insulated non-metallic material; an acrylic plastic; a fiberglass compound; a polymer; a high density plastic material; a resin reinforced fiberglass; a dielectric material with a particular electrical rating, or any material that may be durable enough to withstand outdoor weather conditions (if the fuse holder is placed outside), and does not generally conduct electricity. The mounting bracket 204 may be made of a similar or different material than the mounting support 202, depending on the strength requirements needed for the material to support the weight of the fuse holder 100.

The first hollow support 102A, the second hollow support 102B, the top support 106, the bottom support 107, the attachment support 108, and the mounting support 202 are illustrated as separate supports. These supports, or any subset thereof, however, may be formed as a single molded body. In an alternative embodiment, mechanical clamps 150 (illustrated schematically in FIG. 1) may be used to connect each of the supports to one another.

Figure 4A:
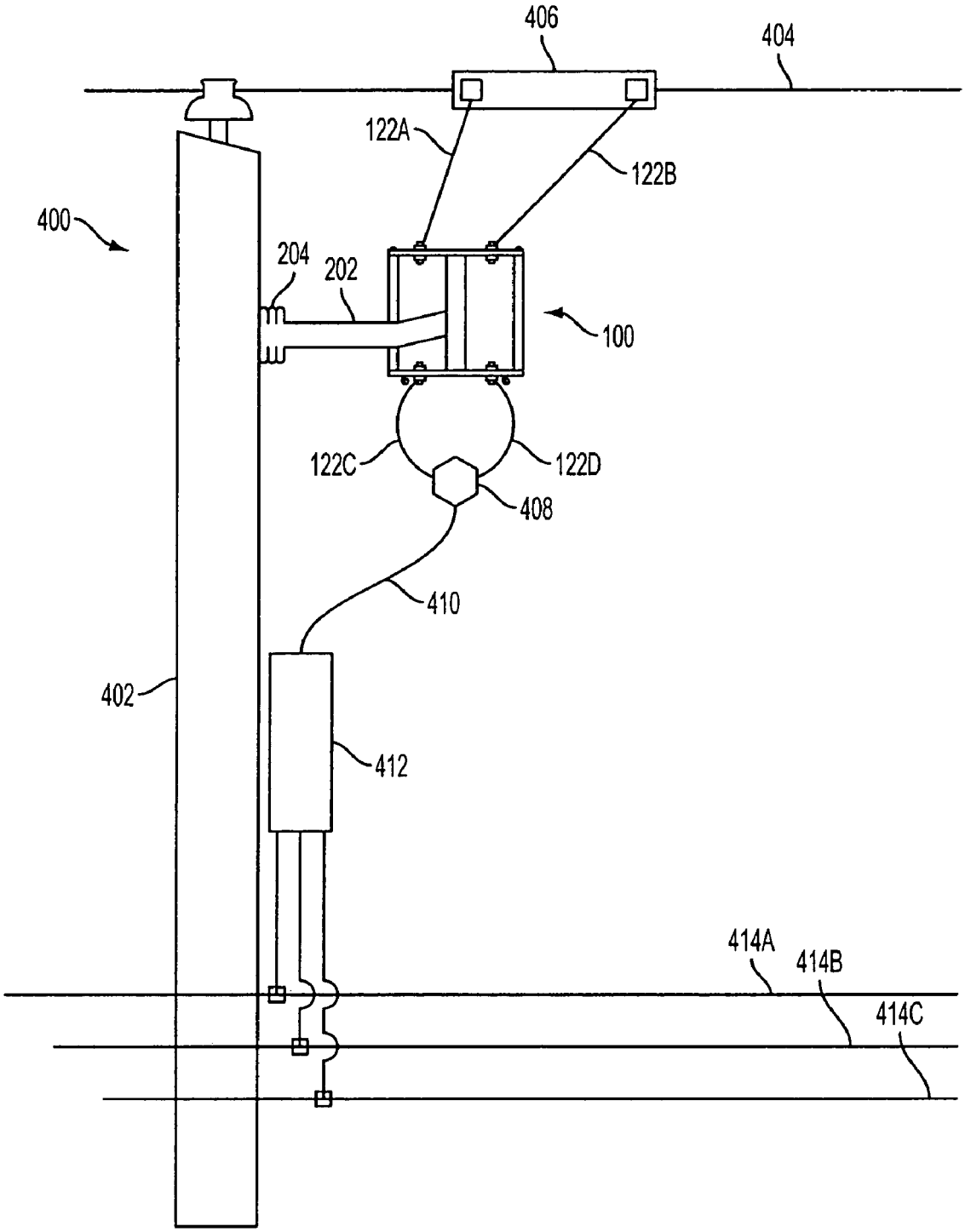
FIGS. 4A and 4B illustrate an exemplary embodiment of a PLC system incorporating the dual fuse holder of FIG. 1.
Figure 4B:
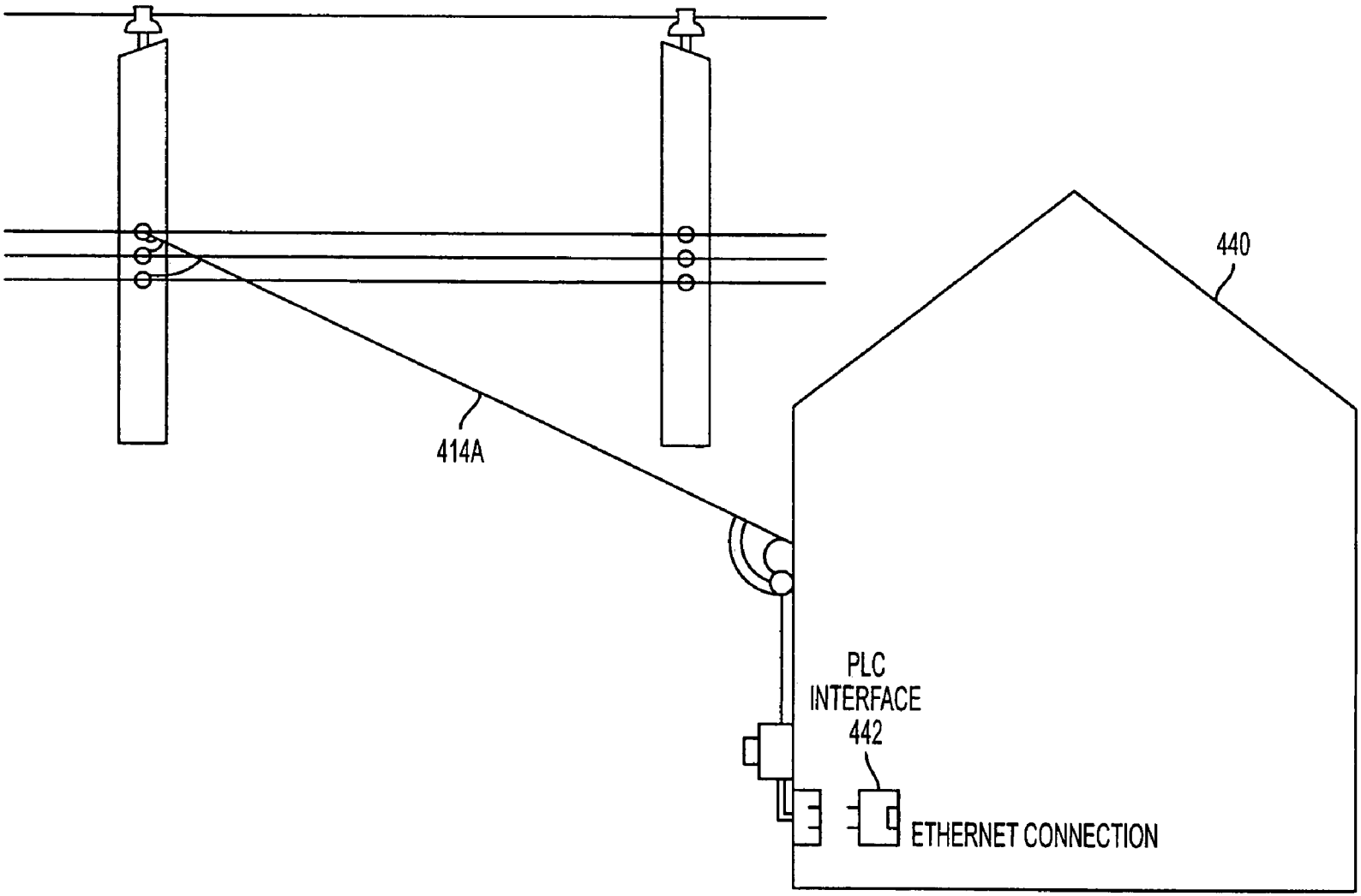

FIGS. 4A and 4B illustrate an exemplary PLC system incorporating the dual fuse holder 100 of the present invention. The fuse holder 100 provides protection and an easy disconnection point between electrical utility distribution lines and PLC equipment. The PLC system may incorporate the fuse holder 100 to bypass a transformer between a primary power line 404 and secondary power lines 414A, 414B, and 414C. The fuse holder 100 may be situated in a PLC system external or internal to a building. The fuse holder 100 may be coupled between the primary power line 404 and the secondary power lines 414A, 414B, and 414C.

Primary power lines (also known as medium voltage lines) may be, for example, electrical power distribution lines operating with a voltage between approximately 0 kilovolts (Kv) and approximately 25 Kv. The primary power lines may, for example, originate from an electrical substation operated by an electrical utility distribution system (or electrical power supplier/company). The secondary power lines 414A, 414B, and 414C (also known as low voltage lines) may be, for example, electrical power distribution lines that operate with a voltage between approximately 0 volts (V) to approximately 600V, which may be, for example, either approximately 120V or approximately 240V. The secondary power lines 414A, 414B, and 414C may be electrically coupled to a building 440 (FIG. 4B), such as, for example, a home or a business. Additionally, other combinations of primary power lines and secondary power lines are possible as will become apparent to those skilled in the art.

A utility pole 402 may be coupled to the primary power line 404. A choke bushing 406 may be electrically and mechanically coupled to the primary power line 404. On either side of the choke bushing 406, the primary power line 404 may be electrically coupled to the electrical line 122A and the electrical line 122B. The electrical line 122A and the electrical line 122B may both be electrically coupled to the fuse holder 100.

A coupler 408 may be electrically coupled to the electrical lines 122C and 122D, which may both be electrically coupled to the fuse holder 100. The electrical lines 122A, 122B, 122C, and 122D may be electrically insulated with high voltage insulation. The high voltage insulation may be designed to stop or interrupt the flow of electricity from a conductor to other conductive materials that may be in contact with or adjacent to an energized conductor.

A coaxial cable 410 may be electrically coupled to the coupler 408 and electrically coupled to a power line bridge 412. The output of the power line bridge 412 may be electrically coupled to the secondary power lines 414A, 414B, and 414C. The secondary power lines 414A, 414B, and 414C may be electrically coupled to a PLC interface 442 (FIG. 4B) in the building 440. The PLC interface 442 may be connected to the wiring of building 440. The wiring of building 440 may be used to form a data network, such as, for example, an Ethernet network. Alternatively, the PLC interface 442 may be coupled to a wireless access point to provide wireless connectivity to customers in and around the building 440, as will become apparent to those skilled in the art.

For the PLC system, a radio frequency (RF) data signal may be received from the primary power line 404 at the choke bushing 406. The choke bushing 406 may divert a RF data signal to the fuse holder 100 through the electrical lines 122A and 122B and generally may only allow the RF data signal to be passed from the primary power line 404 to electrical lines 122A and 122B. The RF data signal may pass through the fuse holder 100 to the coupler 408. The connection from the choke bushing 406 to the coupler 408 across the dual fuse holder 100 may be considered a loop containing two fuse links providing two separate electrical paths across the fuse holder 100, with a fuse link 104A and 104B respectively in each of the separate paths.

Since generally only the RF data signal may be allowed to pass through the dual fuse holder 100, the connection may be considered a "zero current" connection. A zero current connection may include sufficient electrical current to transport RF data signals. In the zero current connection, the electrical current required to transport the RF data signals may be much smaller as compared to the electrical current used in electrical utility power distribution.

The RF data signal may be received at the power line bridge 412 from the coupler 408, where the RF data signal may be passed to the secondary power lines 414A, 414B, and 414C leading into the building 440. It is noted that the RF data signal is described as being received from the primary power line 404; however, the fuse holder 100 may also receive RF data signals from the secondary power lines 414A, 414B, and 414C and pass the RF data signals to the primary power line 404. The RF data signal may be considered forced or channeled through the dual fuse holder 100 as the RF data signal may be transmitted either to the secondary lines 414A, 414B, and 414C, or to the primary power line 404 for services and communication with the PLC system.

The fuse holder 100 is not limited solely to being mounted to a utility pole. For example, the fuse holder may be mounted to any fixed item between a primary power line 404 and secondary power lines 414A, 414B, and 414C, as will be appreciated by those skilled in the art. Depending on where and how the fuse holder 100 is placed, the mounting support 202 and the mounting bracket 204, or other devices and device combinations, may be used or omitted to attach the fuse holder 100.

Figure 5:
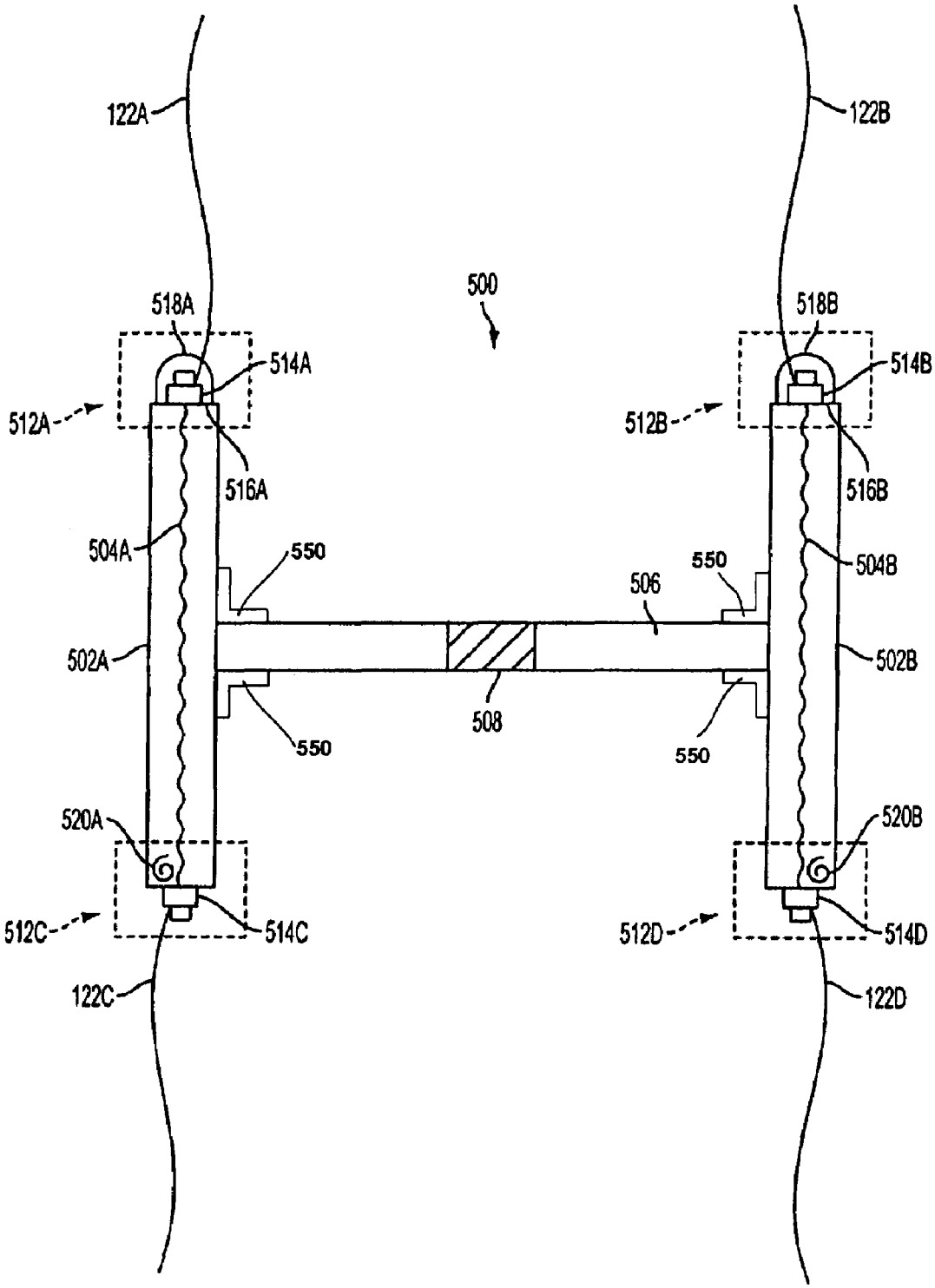
FIG. 5 illustrates a second exemplary embodiment for a dual fuse holder according to an embodiment of the invention.
Figure 6:
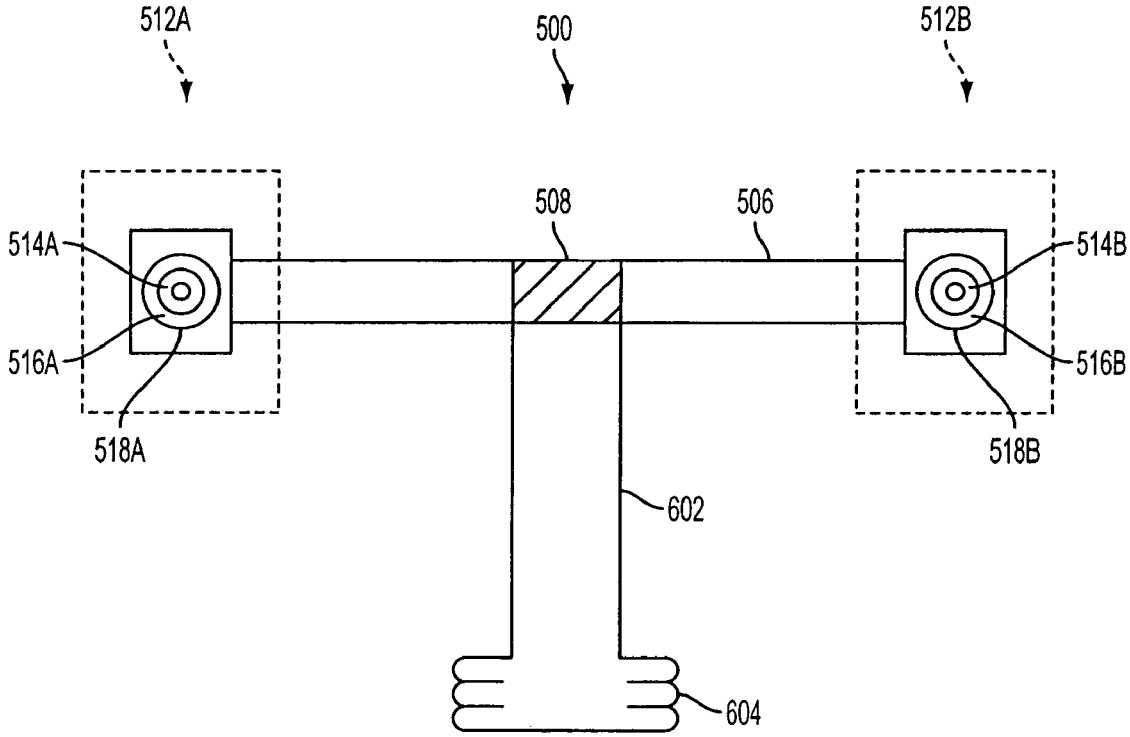
FIG. 6 illustrates a top view of the dual fuse holder depicted in FIG. 5.
Figure 7:
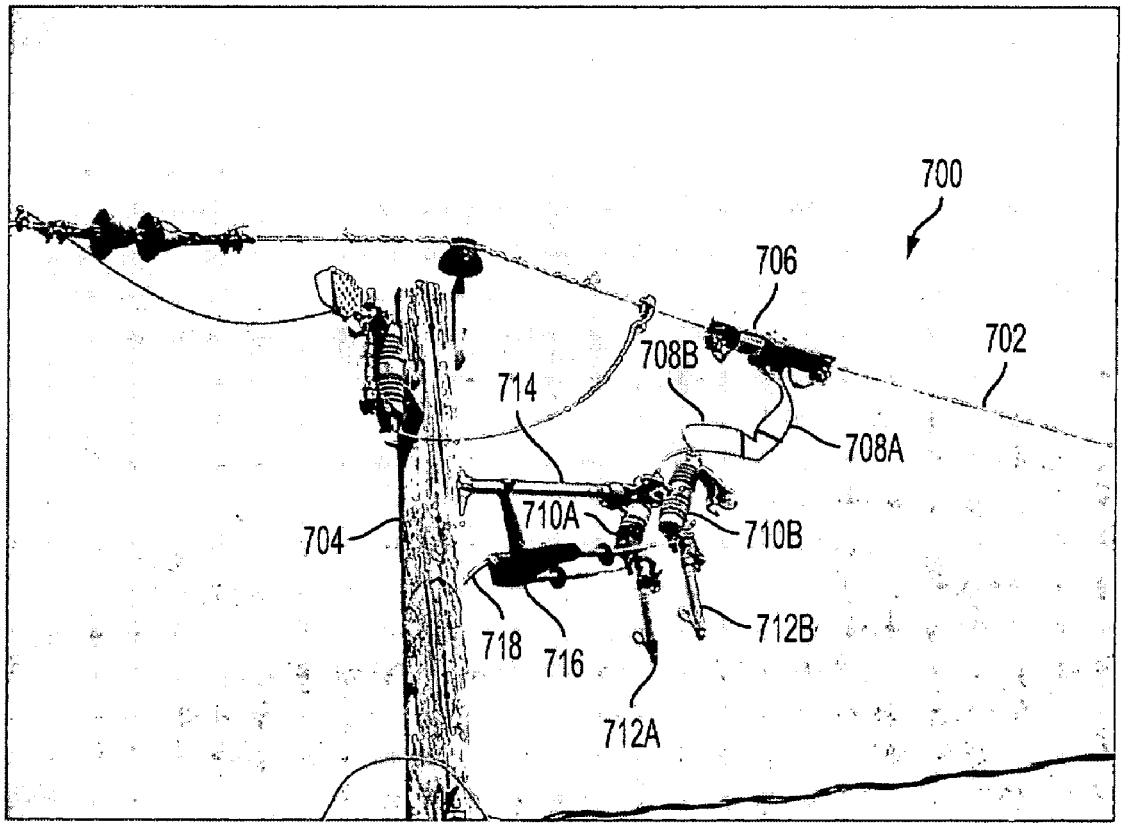
FIG. 7 PRIOR ART
FIG. 7 provides a photograph of a portion of a PLC system using conventional electrical utility distribution equipment.

FIG. 5 depicts a front view of a second embodiment of a dual fuse holder 500 according to an exemplary embodiment of the invention. FIG. 6 illustrates a top view of the dual fuse holder 500 depicted in FIG. 5. It may be noted that the fuse holder 500 may be symmetric, as depicted; however, an asymmetric fuse holder may be constructed, as will be appreciated by those skilled in the art. The fuse holder 500 may replace fuse holder 100 in the PLC system depicted in FIGS. 4A and 4B.

The second embodiment differs from the first embodiment in that the top support 106 and bottom support 107 may be replaced with a single support. For the second embodiment, a first hollow support 502A and a second hollow support 502B may contain a fuse link 504A and a fuse link 504B, respectively. The fuse links 504A and 504B may not be visible from the exterior of the hollow supports 502A and 502B and are illustrated in the drawings to depict the invention. An attachment support 506 may be coupled between the first hollow support 502A and the second hollow support 502B. Alternatively, the attachment support 506 may be a single top support connected in the upper half of both the first hollow support 502A and the second hollow support 502B, or it may be a single bottom support connected in the lower half of the first hollow support 502A and the second hollow support 502B, as will become apparent to those skilled in the art. A mounting support 602 (FIG. 6) may be coupled to the attachment support 506 at an attachment area 508, and the mounting support 602 may include a mounting bracket 604. The attachment area 508 is shown as a hashed area for illustrative purposes to depict where the mounting support 602 couples to the attachment support 506. Alternatively, the attachment area 508 may be positioned at other locations on the attachment support 506, on either of the hollow supports 502A or 502B, or on any combination of one or more of the supports as will be appreciated by those skilled in the art.

Connection devices 512A and 512C may be coupled to the respective ends of the first hollow support 502A, and the connection devices 512B and 512D may be coupled to the respective ends of the second hollow support 502B. The connection device 512A may include a wire connector 514A and a conductive strip 516A. The conductive strip 516A may electrically couple to the first fuse link 504A and the wire connector 514A. The wire connector 514A may electrically couple the conductive strip 516A and the electrical line 122A. Alternatively, the wire connector 514A may electrically couple the first fuse link 504A and the electrical line 122A without using the conductive strip 516A. Caps 518A and 518B may be placed on the top ends of the respective hollow supports 502A and 502B. Caps may be omitted from the bottom ends of the hollow supports 502A and 502B to allow for ventilation and to prevent moisture accumulation within the hollow supports 502A and 502B. Components similar to those of the connection device 512A, such as wire connectors 514B-514D and conductive strips 516B-516D, may be in part of the connection devices 512B, 512C, and 512D. The connection devices 512B, 512C, and 512D may or may not be the same.

The connection devices 512C and 512D may also include springs 520A and 520B attached to provide tension on the respective fuse links 504A and 504B. The springs 520A and 520B may be internal or external to the hollow supports 502A and 502B. When the fuse links 504A and 504B, for example, melt, the springs 520A and 520B may pull the fuse links 504A and 504B to create an electrical open circuit. Alternatively, the springs 520A and 520B may be incorporated into a cast fitting to provide tension on the fuse links 504A and 504B. The cast fitting may include a hinge, and when the fuse links 504A and 504B, for example, melt, the springs 520A and 520B may pull the fuse links 504A and 504B apart to cause the hinge to separate, thereby creating an electrical open circuit. In a further alternative embodiment, the springs 520A and 520B may be located at other locations on fuse holder 500. Other devices may be used to provide tension on the fuse links 504A and 504B, as will become apparent to those skilled in the art.

The first hollow support 502A, the second hollow support 502B, the attachment support 506, and the mounting support 602 of fuse holder 500 may be made of materials similar to those used in fuse holder 100. The fuse links 504A and 504B may be made of materials similar to those used in fuse links 104A and 104B.

The first hollow support 502A, the second hollow support 502B, and the single support 506 are illustrated as separate supports. These supports, or any subset thereof, however, may be formed as a single molded body. In an alternative embodiment, mechanical clamps 550 (illustrated schematically in FIG. 5) may be used to connect each of the supports to one another.

The description of the present invention has been described with respect to two hollow supports containing fuse links; however, more hollow supports may be used without departing from the spirit and scope of the invention.

The embodiments and examples discussed herein are non-limiting examples.

The invention is described in detail with respect to exemplary embodiments, and it will now be apparent from the foregoing to those skilled in the art that changes and modifications may be made without departing from the invention in its broader aspects, and the invention, therefore, as defined in the claims may be intended to cover all such changes and modifications as fall within the true spirit of the invention.

What is claimed is:

1. A system to electrically couple a primary power line to at least one secondary power line comprising:

a choke bushing electrically coupled to the primary power line;

a fuse holder electrically coupled to the primary power line at said choke bushing, said fuse holder comprising:

a first hollow support containing a first fuse, said first hollow support comprising a plurality of first electrical connection devices;

a second hollow support containing a second fuse, said second hollow support comprising a plurality of second electrical connection devices; and a support member coupled to said first hollow support and said second hollow support, wherein said support member, said first hollow support, and said second hollow support are made of a non-conductive material;

a coupler electrically coupled to said fuse holder; and a power line bridge electrically coupled between the at least one secondary power line and said coupler.

2. The system according to claim 1, wherein one or more high voltage electrically insulated wires are electrically coupled between the fuse holder and said coupler.

3. The system according to claim 1, wherein a coaxial cable is electrically coupled between said coupler and said power line bridge.

4. The system according to claim 1, wherein the primary power line is electrically coupled to an electrical utility distribution system.

5. The system according to claim 1, wherein the at least one secondary power line is electrically coupled to a building.

6. The system according to claim 1, wherein said choke bushing diverts a radio frequency data signal into the fuse holder.

7. The system according to claim 1, wherein the fuse holder is adapted to receive a radio frequency data signal from at least one of the primary power line or the at least one secondary power line.

8. The system according to claim 7, wherein said radio frequency data signal is forced or channeled through the fuse holder.

* * * * *